US010179944B2

(12) United States Patent
Tatsuzawa et al.

(10) Patent No.: US 10,179,944 B2
(45) Date of Patent: Jan. 15, 2019

(54) TITANIUM SLAB FOR HOT ROLLING USE AND METHOD OF PRODUCTION OF SAME

(75) Inventors: Yoshitsugu Tatsuzawa, Tokyo (JP); Hideki Fujii, Tokyo (JP); Tomonori Kunieda, Tokyo (JP); Kazuhiro Takahashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 269 days.

(21) Appl. No.: 14/009,837

(22) PCT Filed: Apr. 19, 2012

(86) PCT No.: PCT/JP2012/060620
§ 371 (c)(1),
(2), (4) Date: Oct. 4, 2013

(87) PCT Pub. No.: WO2012/144561
PCT Pub. Date: Oct. 26, 2012

(65) Prior Publication Data

US 2014/0027024 A1 Jan. 30, 2014

(30) Foreign Application Priority Data

Apr. 22, 2011 (JP) ..... 2011-095903

(51) Int. Cl.

| | |
|---|---|
| ***B22D 7/00*** | (2006.01) |
| ***C22F 1/18*** | (2006.01) |
| ***B22D 11/00*** | (2006.01) |
| ***B22D 21/00*** | (2006.01) |
| ***B22D 30/00*** | (2006.01) |
| ***C22C 14/00*** | (2006.01) |

(52) U.S. Cl.
CPC ..... *C22F 1/183* (2013.01); *B22D 7/005* (2013.01); *B22D 11/001* (2013.01); *B22D 21/005* (2013.01); *B22D 30/00* (2013.01); *C22C 14/00* (2013.01)

(58) Field of Classification Search
CPC ..... B22D 7/005; B22D 11/001; B22D 7/00; C22F 1/183
See application file for complete search history.

(56) References Cited

U.S. PATENT DOCUMENTS

| | | | | |
|---|---|---|---|---|
| 3,905,837 A * | 9/1975 | Du Bois | ..... | 148/264 |
| 4,581,077 A | 4/1986 | Sakuyama et al. | | |
| 5,092,940 A * | 3/1992 | Kimura | ..... | C22C 14/00 148/670 |
| 2011/0318597 A1 | 12/2011 | Takahashi et al. | | |

FOREIGN PATENT DOCUMENTS

| | | |
|---|---|---|
| JP | 8-60317 | 3/1996 |
| JP | 2007-332420 | 12/2007 |
| JP | 2008115419 A * | 5/2008 |
| JP | 4414983 | 2/2010 |
| WO | 2010/090353 | 12/2010 |

OTHER PUBLICATIONS

International Search Report dated Jun. 5, 2012 issued in corresponding PCT Application No. PCT/JP2012/060620.
Extended European Search Report dated Jan. 23, 2015 issued in corresponding EPC Application No. 12774466.2.
Daido Steel, Chemical Composition of Commercially-Pure Titanium, http://www.daido.co.jp/en/products/titanium/chemical.html, accessed on Apr. 7, 2016.
Fort Wayne Metals data sheet for Unalloyed Commercially Pure (CP) Titanium, http://www.fwmetals.com/materials/titanium/cp-titanium/, accessed on Apr. 7, 2016.
North American Alloys Technical Data sheet on Commercially Pure Titanium, http://www.northamericanalloys.com/CPTi%20props.htm, accessed on Apr. 7, 2016.

* cited by examiner

*Primary Examiner* — Edward M Johnson
(74) *Attorney, Agent, or Firm* — Birch, Stewart, Kolasch & Birch, LLP

(57) ABSTRACT

A titanium slab for hot rolling comprised of a titanium slab obtain by smelting commercially pure titanium, wherein even if the breakdown process is omitted, the strip shaped coil after hot rolling is excellent in surface properties and a method of smelting that titanium slab are provided. The titanium slab according to the present invention is a titanium slab for hot rolling obtained by smelting commercially pure titanium including the β phase stabilizing element Fe, wherein the formation of coarse β phases is suppressed by making the average Fe concentration down to 10 mm from the surface layer of the surface which corresponds to at least the rolling surface of the titanium slab 0.01 mass % or less. A titanium slab obtained by smelting commercially pure titanium can be obtained by cooling until the surface becomes the β transformation point or less, then reheating it to the β transformation point or more, and gradually cooling from the slab surface layer.

4 Claims, No Drawings

TITANIUM SLAB FOR HOT ROLLING USE AND METHOD OF PRODUCTION OF SAME

This application is a national stage application of International Application No. PCT/JP2012/060620, filed Apr. 19, 2012, which claims priority to Japanese Application No. 2011-095903, filed Apr. 22, 2011, the content of which is incorporated by reference in its entirety.

TECHNICAL FIELD

The present invention relates to a titanium slab for hot rolling made of commercially pure titanium and a method of producing that titanium slab. In particular, it relates to a titanium slab for hot rolling which enables the surface properties of a strip shaped coil to be maintained well even after hot-rolling directly a block shaped ingot produced by the electron beam melting method or plasma arc melting while omitting a breakdown process, such as the blooming, forging or the other like, and a method of producing the same.

BACKGROUND ART

Titanium and titanium alloy are generally provided in the form of ingots obtained from sponge titanium or titanium scrap materials by melting using the consumable electrode type vacuum arc melting method or the electron beam melting method and solidification. These ingots are subjected to blooming, forging, rolling or other hot-working, and are worked to the shape of slabs which can be rolled using a hot rolling mill, and then are touched up on their surfaces to obtain slabs for hot rolling.

In the melting process, the consumable electrode type vacuum arc melting method is being widely used, but the arc discharge between the electrode and the casting mold has to be uniformly performed, so the casting mold is limited in shape to a cylindrical mold. As opposed to this, in the case of the electron beam melting method using a hearth or the plasma arc melting method, the melt of the titanium which was melted in the hearth flows into the casting mold, so there is no limit on the casting mold shape. Not only a cylindrically shaped, but also a block shaped ingot can be produced. When using a block shaped ingot to produce a flat product, due to its shape, it is conceivably possible to perform the hot rolling while omitting the blooming, forging, and other hot-working process. The costs can be reduced by that amount attributable to the omission. Therefore, the technique of hot rolling while omitting hot-working by using a block shaped titanium ingot which was cast by means of a rectangular casting mold as is as a titanium slab for hot rolling has been studied. Here, the blooming, forging, or other hot-working process which is performed before hot rolling will be referred to overall as the "breakdown process".

In this regard, in a titanium slab which is cast by means of electron beam melting or plasma arc melting in a block shaped casting mold, the slab produced industrially has crystal grains of a size of several dozen mm in the structure as cast. Further, commercially pure titanium contains some Fe or other impurity elements. Depending on the case, β phases will sometimes form at the hot rolling temperature. The β phases which are formed from the coarse α phases become coarse. The β phases and α phases greatly differ in deformation ability even at a high temperature, so the deformation becomes uneven between the coarse β phases and α phases and large surface defects sometimes result. To remove the surface defects which are formed during the hot rolling, it is necessary to increase the ablation amount of the hot rolled plate surface in the acid pickling process, so the yield deteriorates. That is, as explained above, with a block shaped titanium slab which is produced by electron beam melting or plasma arc melting and for which breakdown process can be omitted, a drop in the production cost can be expected, but a drop in yield would be a concern.

PLT 1 discloses a method of producing a thick plate or slab of titanium during which surface defects are prevented by the method of heating to the (β transformation point+50° C.) or more at the stage of the cast ingot before hot-working, then cooling to a temperature of the (β transformation point-50° C.) or less and refining the coarse crystal grain structure of the cast ingot. However, in PLT 1, the cast ingot is assumed to be a columnar shape. To render it to a slab shape, there is an extremely great drop in yield. Further, the breakdown process before hot rolling is also essential, so compared with a block shaped titanium ingot, the production costs become higher. In addition, a consumable electrode type vacuum arc melting furnace which produces a columnar shaped cast ingot structurally cannot continuously perform the above heat treatment at the time of melting. A heat treatment step is added, so a rise in the production cost is a concern.

PLT 2 discloses a method of drawing out a titanium slab which was smelted in an electron beam melting furnace directly from the casting mold wherein, at the cross-sectional structure of the slab, when the angle θ between the solidification direction from the surface layer toward the inside and the casting direction of the slab is 45° to 90° or the angle between the c-axis of the hcp and the direction normal to the slab surface layer in the crystal orientation distribution at the surface layer is 35° to 90°, the cast skin is good and the surface defects formed by hot rolling are suppressed and a process for hot-working an ingot, such as blooming, forging, rolling or the like, that is, the so-called breakdown process may be omitted. That is, by controlling the shape or crystal orientation of the crystal grains at the surface, it is possible to suppress the formation of flaws due to such coarse crystal grains. However, PLT 2 does not consider the possibility of a large amount of the β phases being formed at the time of heating in the hot rolling. It is believed that good surface properties are obtained, but variations in the operating conditions and the method of slab production are liable to cause the possibility of deterioration of the surface properties.

PLT 3 discloses a method of directly hot rolling an ingot of a titanium material while omitting blooming process comprising melting and resolidifying the surface layer at the surface corresponding to the rolling surface of the ingot by high frequency induction heating, arc heating, plasma heating, electron beam heating, laser heating, etc. to refine the particle size down to a depth of 1 mm or more from the surface layer and improving the structure of the surface layer after hot rolling. This rapidly solidifies the surface layer part to form a fine solidified structure with irregular orientation and thereby prevent the formation of surface defects. As methods for making the structure of the surface layer of the titanium slab melt, high frequency induction heating, arc heating, plasma heating, electron beam heating, and laser heating may be mentioned. However, with the TIG welding method of arc heating which is industrially used for titanium materials, much time is taken for treatment per area. Further, even with a melting method other than arc heating, high expenses are incurred in introduction of facilities for improvement of the structure of the surface layer of the slab.

Furthermore, electron beam heating etc. usually have to be performed in a $10^{-5}$ Torr or so vacuum, so there are great restrictions facility wise. That is, a rise in the production costs is feared.

CITATIONS LIST

Patent Literature

PLT 1: Japanese Patent Publication No. 8-060317A
PLT 2: WO2010/090353A
PLT 3: Japanese Patent Publication No. 2007-332420A

SUMMARY OF INVENTION

Technical Problem

As explained above, in a block shaped titanium ingot which is smelted by the electron beam melting method or plasma arc melting method, at the structure near the surface layer comprised of coarse particles, if heating to the hot rolling temperature while omitting the breakdown process, Fe and other β phase stabilizing elements which are contained in commercially pure titanium are present in large amounts near the surface layer. Sometimes, the coarse β phases are formed near the surface layer of the slab. In such a case, since the coarse β phases and the adjacent coarse α phases differ in deformation ability, irregular deformation occurs, so relief shapes form at the slab surface and the surface properties become degraded. Such relief shapes, as explained above, are liable to develop into surface defects and invite a drop in yield of the hot rolled plate.

The present invention has as its object to provide a titanium slab which is cast by an electron beam melting furnace wherein even if hot rolling is performed to the titanium slab while omitting the conventionally required blooming, forging, and other breakdown process, formation of surface defects is difficult and a titanium slab with good surface properties can be obtained.

Solution to Problem

The inventors engaged in intensive studies to solve the above problem and as a result discovered that in a titanium slab of commercially pure titanium, by cooling down to room temperature or the α phase temperature region at the time of production or after production, then reheating to the β transformation point or more and cooling, it is possible to keep down the concentration of Fe of the slab surface layer and hold the surface properties after hot rolling well. The present invention was made based on this finding and has as its gist the following:

(1) A titanium slab for hot rolling which is produced from commercially pure titanium, the titanium slab for hot rolling characterized in that an average Fe concentration down to 10 mm in the thickness direction from the surface layer at the surface corresponding to the rolling surface is 0.01 mass % or less.

(2) A titanium slab for hot rolling as set forth in (1), characterized in that in a cross-section vertical to the longitudinal direction of the titanium slab for hot rolling, the former β grains of the structure are equiaxial.

(3) A method of production of a titanium slab for hot rolling which uses a melting furnace using a hearth to melt commercially pure titanium to produce a titanium slab, the method of production of a titanium slab for hot rolling characterized by melting, then cooling commercially pure titanium to produce a titanium slab during which it cools the surface of the titanium slab down to a β transformation point or less, then again heats it to the β transformation point or more, then gradually cools the slab.

(4) The method of production of a titanium slab for hot rolling as set forth in (3) characterized in that the melting furnace using a hearth is an electron beam melting furnace.

(5) The method of production of a titanium slab for hot rolling as set forth in (3) characterized in that the melting furnace using a hearth is a plasma arc melting furnace.

Advantageous Effects of Invention

The present invention provides a titanium slab which was cast by an electron beam melting furnace wherein even if hot rolling while omitting the conventionally necessary blooming, forging, or other breakdown process, it is possible to produce a titanium slab resistant to formation of surface defects and good in surface properties. By omitting the breakdown process and thereby reducing the heating time and by reducing the amount of dissolution at the time of pickling and thereby improving the yield, it is possible to greatly improve the production costs. The effects in the industry are immeasurable.

DESCRIPTION OF EMBODIMENTS

Below, the present invention will be explained in detail.

[1] Average Fe Concentration Down to 10 mm from Surface Layer of Slab in Thickness Direction: 0.01 Mass % or Less:

Usually, pure titanium is hot rolled at the β transformation point or lower temperature. If the β transformation point or lower temperature region is the α single phase region, the structure at the time of hot rolling becomes only α phases. However, commercially pure titanium used as the raw material unavoidably contains Fe etc. as an impurity. Further, to obtain strength, Fe, O, or another element may be added in a small amount. In particular, the β phase stabilizing element of Fe is contained in 0.020 mass % in the lower strength commercially pure titanium JIS Type 1 and is sometimes added to 0.500 mass % in the highest strength commercially pure titanium JIS Type 4. That is, the Fe content of commercially pure titanium is 0.020 mass % or more. Therefore, in commercially pure titanium, at the β transformation point or less, there are two phase regions of the α phases and the β phases.

If the β phase stabilizing element of Fe is included in a large amount, if heating to the β transformation point or less α+β two-phase temperature, β phases are formed and much of them become coarser. It is learned that if the β phases are present at least within 10 mm in the thickness direction of the slab from the surface layer of the surface corresponding to the rolling surface, in particular, the surface properties of the slab deteriorate. That is, the β phases which are generated due to the coarse α phases easily become coarse. When these coarse β phases are mixed in, a difference in deformation ability occurs between crystal grains at the time of hot rolling and the surface properties are made to deteriorate.

It is learned that in order to suppress the appearance of the β phases within 10 mm in the thickness direction of the slab from the surface layer of the surface corresponding to the rolling surface of the slab, the average Fe concentration in this region should be made 0.01 mass % or less. An advantageous effect is achieved if the region in which the average Fe concentration is 0.01 mass % or less is down to 10 mm from the surface layer of the surface corresponding to the rolling surface of the slab. To further mitigate the surface defects, it is more preferable that the region in which the average Fe concentration is 0.01 mass % or less be in a region down to 20 mm from the surface layer corresponding to the rolling surface of the slab. More preferably, the average Fe concentration down to 10 mm from the surface layer of the surface corresponding to the rolling surface of the slab may be made 0.06 mass % or less, while the average Fe concentration down to 20 mm may be made 0.09 mass %.

That is, the present invention firstly provides a block shaped titanium ingot which is obtained from a titanium slab comprised of commercially pure titanium wherein an average Fe concentration down to 10 mm in the thickness direction from the surface layer at the surface corresponding to the rolling surface of the slab is 0.01 mass % or less.

[2] In a Cross-Section Vertical to the Rolling Direction of the Titanium Slab, the Former β Grains of the Structure are Equiaxial The present invention secondly provides a titanium slab for hot rolling wherein in the cross-sectional structure, the former β grains are equiaxial. The former β grains are coarse, so their shapes can be easily visually confirmed. Here, the crystal grains being equiaxial indicates that the ratio of the long axis and the short axis of the crystal grains is small and is defined as the case where the value of the long axis/short axis is 1.5 or less. Further, a shape in which the value of the long axis/short axis is larger than 1.5 is defined as the stretched state. In the present invention, as explained above, it is necessary to make the concentration of Fe of the slab surface layer 0.01 mass % or less. For this reason, as explained later, it is necessary to cool down to the β transformation point or less, then reheat again to the β transformation point or more.

However, titanium is an extremely active metal, so the casting is performed in a vacuum. It is difficult to accurately measure the slab temperature at the time of casting. Further, even if reheating to the β phase region temperature (β transformation point or more) after casting, to prevent the crystal grains of the β phases from coarsening more than necessary and prevent uniform formation of Fe, the temperature is preferably right above the β transformation point as much as possible. Therefore, it is necessary to obtain a grasp as to if the titanium slab has been sufficiently heated to right above the β transformation point.

Therefore, first, the inventors studied the method of reheating to the β phases. As a result, they discovered that learning the heating temperature from the shape of the former β grains of the cross-sectional structure is relatively easy. In the titanium, the β phases are stable at a high temperature, so the β phases grow at the time of solidification. At that time, the solidified grains grow in parallel in the heat flux direction and become extremely coarse stretched grains. After that, when the slab is further cooled down to the β transformation point or less, pin-shaped α phases form in the β phases. For this reason, if the transformation from the β phases to the α phases occurs only once, the former β phase grains remain as stretched grains.

On the other hand, if cooling down to the α phase region, then again heating to the β phase region temperature (β transformation point or more), at the α phase grain boundaries and the former β phase grain boundaries, the β phases form nuclei. At the β phase region temperature, the β phases grow to become equiaxial. In this case, the stretched grains which were formed at the time of solidification completely disappear and become only equiaxial β phases which are formed by reheating. After that, even if again transforming to the α phases and the α phases form in the former β phases, the former β grain boundaries remain equiaxial. Therefore, if the former β grains at the cross-sectional structure are equiaxial, it is possible to learn if the slab has been reheated and raised to the β phases. That is, in a titanium slab which is produced by using an commercially pure titanium material including a relatively high concentration of Fe, the former β grains being equiaxial shows that the slab was heated to the β transformation point or more and then was cooled whereby β→α transformation occurred.

Conversely speaking, if heating the titanium slab, which was cooled once down to the α phase region temperature, again up to the β phase region temperature and then cooling down to the α phase region temperature, inside the cross-section of the slab, the ratio of the long axis and short axis of the former β grains (value of long axis/short axis) becomes 1.5 or less, that is, an equiaxial state. More preferably, the value of the long axis/short axis should become 1.3 or less.

As explained later, in the region where such a β→α transformation occurs, it is guaranteed that the concentration of Fe will fall. It was learned that in a titanium slab, if the ratio of the long axis/short axis of the former β grains is 1.5 or less, the concentration of Fe at the surface sufficiently falls and generally becomes about 0.01 mass % or less.

[3] Method of Production

The method of production of the titanium slab for hot rolling of the present invention will be explained. In the process of melting the titanium slab using an electron beam melting furnace, solidification proceeds from the slab surface layer part contacting the casting mold, and so for each element, the slab surface layer and inside slightly differ in ingredients due to the solute partitioning. The above β phase stabilizing element of Fe is an element which exhibits positive segregation. Therefore, at the time of solidification or the time of transformation, the Fe concentration of the slab surface layer part tends to become lower and the Fe concentration tends to become higher the more to the inside of the slab. However, with just the solidification process, it is difficult to control the Fe concentration near the surface layer to the 0.01 mass % of the present invention.

As opposed to this, in the present invention, the inventors discovered that by reheating again to the β phase region temperature from the β transformation point temperature or less, then utilizing the solute partitioning which forms at the time of transformation from the β phases to the α phases, it is possible to reduce the Fe concentration near the slab surface layer to the concentration prescribed in the present invention. That is, by heating a slab which was once cooled to the β transformation point or less to the β transformation point or more and then lowering the temperature first from the surface of the slab, the transformation from the β phases to the α phases proceeds from the slab surface to the inside. At this time, by utilizing the solute partitioning occurring at the time of transformation from the β phases to the α phases, it is possible to produce a slab low in Fe concentration at the surface layer. At this time, if the cooling is made gradual cooling by air cooling or furnace cooling etc. so as to promote the solute partitioning of Fe, the drop in Fe solute concentration at the surface layer is reduced.

For example, after electron beam melting, the surface layer is cooled in the casting mold. And, the vicinity of the surface layer solidifies, the surface temperature becomes the β transformation point or less, and the slab is pulled out from the casting mold. At this time, the inside of the slab still is in the high temperature molten state. By weakening the cooling of the slab inside of the casting mold, below the casting mold the slab receives heat flux from the center of the slab and the temperature near the slab surface layer can be made to recuperate to the β transformation point or more. After that, along with the progress in solidification of the center part of the slab, heat flux from the center of the slab is also reduced. And, the slab falls in temperature first from the surface, while part of the slab at the β transformation point temperature moves from the slab surface to the inside. By cooling from the slab surface layer by gradual (cooling rate less than air cooling, 1° C./s or less) below the end of the casting mold, it is possible to realize this process.

As opposed to this, in the conventional method, the slab is cooled sufficiently in the casting mold, so even if the titanium slab receives heat flow from the center of the high temperature titanium slab below the casting mold, the titanium surface temperature does not recuperate to the β transformation point temperature or more.

As explained above, in the method of production of a titanium slab for hot rolling of the present invention, the titanium slab is cooled down to the β transformation point or less, then is reheated up to the β transformation point or more and gradually cooled from the slab surface layer. Here, gradual cooling means cooling with a cooling rate of air cooling or less.

Cooling and re-heating up to β transformation point or more (recuperation) as explained above may be performed continuously after the titanium slab surface is cooled down to the β transformation point of the titanium slab surface at the time of production of a titanium slab. Alternatively, it is also possible to have the titanium slab being cooled down to room temperature or to perform this taking a sufficient time. In this case, the heat flux from the center of the high temperature slab does not perform recuperation and the slab is heated from the surface.

Furthermore, the heat treatment for causing this transformation is effective even if performed just once, but by performing it several times, a further reduction in the Fe near the surface layer becomes possible. Therefore, even if performed several times, similar effects can be obtained. Note that, due to electron beam melting, even if producing the slab by the conventional method of production, a similar effect can be obtained by using post-process to heat the titanium slab to the β transformation point or more, then cooling from the slab surface layer.

EXAMPLES

Below, examples will be used to explain the present invention in detail. The invention examples and comparative examples shown in Table 1 were prepared using the titanium slabs produced from the commercially pure titanium JIS Type 2 (the currently used material had an average Fe concentration of three points of the slab of 0.04 to 0.06 mass %). The titanium slabs were cast, then cut at their surfaces and hot rolled using hot rolling facilities of ferrous metal materials to obtain strip shaped coils. Note that, the surface defects were evaluated by visually examining the surface layers of the plates after pickling.

TABLE 1

| | Material | | | Average Fe concentration within 10 mm | Average Fe concentration within 20 mm | | | | | |
|---|---|---|---|---|---|---|---|---|---|---|
| No. | Type | Fe concentration (mass %) | Hot rolling pretreatment | of surface layer (mass %) | of surface layer (mass %) | Shape of crystal grains | Long axis/ short axis | Surface defects | Evaluation | Remarks |
| 1 | Pure titanium JIS Type 2 | 0.046 | None | 0.030 | 0.036 | Stretched | 2.4 | Coarse, large defect frequency | Poor | Comp. ex. |
| 2 | Pure titanium JIS Type 2 | 0.052 | None | 0.034 | 0.037 | Stretched | 2.1 | Coarse | Poor | Comp. ex. |
| 3 | Pure titanium JIS Type 2 | 0.054 | Slab produced by conventional method, and reheated to β region, then gradually cooled | 0.004 | 0.008 | Equiaxial | 1.1 | Slight | Very good | Inv. ex. |
| 4 | Pure titanium JIS Type 2 | 0.053 | | 0.005 | 0.007 | Equiaxial | 1.3 | Slight | Very good | Inv. ex. |
| 5 | Pure titanium JIS Type 2 | 0.047 | | 0.010 | 0.015 | Equiaxial | 1.5 | Slight | Good | Inv. ex. |
| 6 | Pure titanium JIS Type 2 | 0.047 | Slab cast, then returned to β region, then gradually cooled | 0.005 | 0.008 | Equiaxial | 1.2 | Slight | Very good | Inv. ex. |
| 7 | Pure titanium JIS Type 2 | 0.049 | | 0.006 | 0.009 | Equiaxial | 1.2 | Slight | Very good | Inv. ex. |
| 8 | Pure titanium JIS Type 2 | 0.053 | | 0.008 | 0.012 | Equiaxial | 1.1 | Slight | Good | Inv. ex. |
| 9 | Pure titanium JIS Type 2 | 0.049 | | 0.007 | 0.012 | Equiaxial | 1.3 | Slight | Good | Inv. ex. |

The average Fe concentrations down to depths of 10 mm and 20 mm in the thickness direction from the surface layers of the rolling surfaces of the slabs described in Table 1 were measured. These were measured by touching up the surfaces of the slabs, then taking pieces from portions 20 mm and 10 mm from the surface layers at any 50 points of the rolling surfaces and calculating the average Fe concentrations by ICP atomic emission spectrophotometry.

Further, the equiaxiality of the crystal grains was evaluated using the average value of the long axis/short axis values of the twenty crystal grains which were extracted at each of the different cross-sections after cutting any five cross-sections in the width direction of the slabs.

The comparative examples of No. 1 and No. 2 are cases of producing titanium slabs by the conventional method in an electron beam melting furnace. By cooling inside the casting mold from the slab surface, solidification advances from the slab surface to the slab center. Fe exhibits positive segregation, so the Fe concentration is a low value at the slab surface layer, but the average Fe concentration down to 20 mm and 10 mm from the slab surface layer is much higher than 0.01 mass %. Coarse flaws were observed at the slab surface after hot rolling. Further, grains with crystal grain sizes stretched in the slab width direction cross-section were confirmed.

In the examples which are shown from No. 3 to No. 5, an electron beam melting furnace was used in a conventional method to produce titanium slabs, then the slabs were held once at room temperature for several weeks and were reheated using an air heating furnace to right above the β transformation point and were cooled slowly from the slab surface layer by furnace cooling by 0.001 to 0.01° C./s. Thereby these examples were produced as the final slabs.

The examples of No. 3 and No. 4 are the results of slabs with both average Fe concentrations 10 mm and 20 mm from the slab surface layers of a low 0.01 mass % or less. The pickled plates had only minor surface defects. The surface properties were extremely good. Further, the long axis/short axis values of the crystal grains were also 1.5 or less, that is, the grains were equiaxial.

The example of No. 5 had an average Fe concentration 10 mm from the surface layer of 0.01 mass % or less, but the concentration of Fe 20 mm from the surface layer was greater than 0.01 mass %. The pickled plates had only minor surface defects, but compared with the examples of No. 3 and No. 4, the surface defects of the plates increased somewhat. The example of No. 5 was heat treated in the same way as the examples of No. 3 and No. 4, so the long axis/short axis ratio of the crystal grains was also 1.5 or less, that is, the grains were equiaxial.

In the examples of No. 3 to No. 5, it was observed that the higher the average Fe concentration down to 10 mm and 20 mm from the slab surface layers, the surface defects are observed to tend to become greater or coarser in extent. It is believed that because the Fe concentration near the slab surface layer becomes higher, the amount of formation of the β phases near the surface layer at the time of hot rolling becomes greater and the difference between the deformation abilities of the α phases and the β phases caused more surface defects to form.

The examples shown from No. 6 to No. 9 are examples in which, in the process of casting the slab from electron beam melting, the slab is cooled in the casting mold more gradually than the past and the slab surface rises to the β transformation point temperature or more by recuperation. The slab was produced under conditions, where the structure near the slab surface layer solidifies once in the casting mold and the slab surface temperature is cooled to not more than the β transformation point and then the slab surface recuperates not less than the β transformation point through the heat input from the melt pool at the center of the slab.

The examples of No. 6 and No. 7 are the results of slabs with both average Fe concentrations down 10 mm and 20 mm from the slab surface layers of a low 0.01 mass % or less. The pickled plates had only minor surface defects. The surface properties were extremely good. Further, the long axis/short axis values of the crystal grains were also 1.5 or less, that is, the grains were equiaxial.

The examples of No. 8 and No. 9 had average Fe concentrations down to 10 mm from the surface layers of 0.01 mass % or less, but the results were slabs with average Fe concentrations down to 20 mm from the surface layers greater than 0.01 mass %. The surface defects of the plates after pickling were minor, but if comparing the examples of No. 6 and No. 7, the frequency of surface defects of the plates became somewhat greater. Further, the long axis/short axis of the crystal grains became 1.5 or less giving equiaxial type particles.

From the examples of No. 6 to No. 9 as well, the higher the average Fe concentration down to 10 mm and 20 mm from the surface layer, the more the surface defects are observed to tend to become greater or coarser in extent. In the same way as the examples of No. 3 to No. 5, by making the Fe concentration near the slab surface layer higher, the amount of formation of the β phases near the surface layer at the time of hot rolling becomes greater. It is considered that due to the difference in deformation abilities of the α phases and β phases, the occurrence of surface defects became greater.

In the examples shown in from No. 3 to No. 5 produced by casting the slabs and then heating the slabs in an atmospheric heating furnace to the β transformation point or more, and also in the examples of No. 6 to No. 9 in which the slabs were continuously heat treated at the time of casting the slabs in an electron beam melting furnace, good surface properties could be obtained in the pickled plates.

Therefore, by heating a slab which was cooled once to the β transformation point or less again to the β transformation point or more and gradually cooling it from the slab surface layer, it was confirmed that it becomes possible to make the average Fe concentration down to 10 mm from the surface layer of the rolling surface of the slab 0.01 mass % or less and possible to obtain a slab with good surface properties after hot rolling.

INDUSTRIAL APPLICABILITY

The present invention can be utilized for production of a titanium slab using commercially pure titanium as a material. By hot rolling the titanium slab according to the present invention, it is possible to obtain a titanium plate which has few defects and has good surface properties. This can be broadly utilized in industries utilizing titanium plates.

The invention claimed is:

1. A titanium slab, said titanium slab comprising an average Fe concentration down to 10 mm in a thickness direction from a surface layer at a surface corresponding to the rolling surface of 0.004 to 0.01 mass %, wherein an average Fe concentration down to 20 mm in a thickness direction from a surface layer at a surface corresponding to the rolling surface is higher than the average Fe concentration down to 10 mm.

2. The titanium slab as set forth in claim 1, wherein in a cross-section vertical to a longitudinal direction of the titanium slab, former β grains of a structure are equiaxial.

3. The titanium slab as set forth in claim 1, wherein said titanium slab comprises an average Fe concentration down to 10 mm in a thickness direction from a surface layer at a surface corresponding to the rolling surface of 0.004 to 0.01 mass %, and a ratio of an average Fe concentration down to 20 mm in a thickness direction from a surface layer at a surface corresponding to the rolling surface to the average Fe concentration down to 10 mm is 7:5 to 8:4.

4. The titanium slab as set forth in claim 1, wherein said titanium slab is a heat-treated commercially pure titanium slab.

* * * * *